US009498402B2

(12) United States Patent
Touhey et al.

(10) Patent No.: US 9,498,402 B2
(45) Date of Patent: Nov. 22, 2016

(54) PERSONAL MOBILITY DEVICE

(71) Applicants: Colin Touhey, Brooklyn, NY (US); Henry Ebbott-Burg, Brooklyn, NY (US); Patricia Kavanagh, Brooklyn, NY (US)

(72) Inventors: Colin Touhey, Brooklyn, NY (US); Henry Ebbott-Burg, Brooklyn, NY (US); Patricia Kavanagh, Brooklyn, NY (US)

( * ) Notice: Subject to any disclaimer, the term of this patent is extended or adjusted under 35 U.S.C. 154(b) by 0 days.

(21) Appl. No.: 14/775,330

(22) PCT Filed: Mar. 12, 2014

(86) PCT No.: PCT/US2014/024561

§ 371 (c)(1),
(2) Date: Sep. 11, 2015

(87) PCT Pub. No.: WO2014/165150

PCT Pub. Date: Oct. 9, 2014

(65) Prior Publication Data

US 2016/0030274 A1 Feb. 4, 2016

Related U.S. Application Data

(60) Provisional application No. 61/778,073, filed on Mar. 12, 2013, provisional application No. 61/914,605, filed on Dec. 11, 2013.

(51) Int. Cl.
*A61H 3/04* (2006.01)
*A61H 3/00* (2006.01)

(52) U.S. Cl.
CPC ..... *A61H 3/04* (2013.01); *A61H 2003/002* (2013.01); *A61H 2003/046* (2013.01); *A61H 2201/0107* (2013.01);
(Continued)

(58) Field of Classification Search
CPC ..... A61H 3/04; A61H 2201/1633; A61H 2003/002; A61H 2003/046; A61H 2201/0107; A61H 2201/0161; A61H 2201/0192; A61H 3/00
See application file for complete search history.

(56) References Cited

U.S. PATENT DOCUMENTS 2,305,249 A * 12/1942 Frost ..... A47C 4/42 135/67
2,729,277 A 1/1956 Rechler
4,595,232 A 6/1986 Glenn et al.
(Continued)

FOREIGN PATENT DOCUMENTS

EP 2289478 3/2011

OTHER PUBLICATIONS

International Search Report and Written Opinion for PCT/US2014/024561, dated Jul. 9, 2014.

*Primary Examiner* — John Walters
*Assistant Examiner* — Brian Swenson
(74) *Attorney, Agent, or Firm* — Wiley Rein LLP

(57) ABSTRACT

A personal mobility device includes a frame including first, second, third, and fourth frame members. The first and second frame members are connected, such as by a pivot joint. The third and fourth frame members are connected to collapse in the same plane as the first and second frame members. The first and third, and second and fourth, frame members are also connected via hinges. This allows the device to fold ("collapse") and unfold ("expand") substantially simultaneously in two substantially orthogonal planes. A tension wire assembly is provided that biases the frame into a collapsed configuration; a locking mechanism is provided that holds the frame in an expanded configuration. Alternatively, tendons can bias the frame into an expanded configuration.

19 Claims, 26 Drawing Sheets

(52) U.S. Cl.
CPC ..... *A61H 2201/0161* (2013.01); *A61H 2201/0192* (2013.01); *A61H 2201/1633* (2013.01)

(56) References Cited

U.S. PATENT DOCUMENTS

| | | | | |
|---|---|---|---|---|
| 4,643,211 | A | 2/1987 | Morris et al. | |
| 4,729,395 | A | 3/1988 | Adamson | |
| 5,271,422 | A * | 12/1993 | Sorrell | A61H 3/04 135/66 |
| 5,636,651 | A | 6/1997 | Einbinder | |
| 6,082,813 | A | 7/2000 | Chen | |
| 7,472,921 | B2 | 1/2009 | Harrison et al. | |
| 8,333,208 | B2 | 12/2012 | Miller | |
| D728,920 | S * | 5/2015 | Touhey | D12/130 |
| 2005/0005959 | A1 | 1/2005 | Diamond | |
| 2006/0207841 | A1 | 9/2006 | Kidd et al. | |
| 2010/0313924 | A1 * | 12/2010 | Cho | A45B 1/02 135/66 |
| 2015/0136190 | A1 * | 5/2015 | Thomas | A61H 3/00 135/67 |
| 2015/0297439 | A1 * | 10/2015 | Karlovich | A61H 3/04 280/650 |

* cited by examiner

PERSONAL MOBILITY DEVICE

CROSS-REFERENCE TO RELATED APPLICATIONS

This application is a national stage filing under 35 U.S.C. 371 based upon international application no. PCT/US2014/024561, filed 12 Mar. 2014 and published on 9 Oct. 2014 under international publication no. WO 2014/165150, which claims priority to U.S. provisional application Nos. 61/778,073, filed 12 Mar. 2013 and 61/914,605, filed 11 Dec. 2013. Each of the foregoing applications is, hereby incorporated by reference as though fully set forth herein.

BACKGROUND OF THE INVENTION a. Field of the Invention

The instant invention relates to personal mobility devices. In particular, the instant invention relates to a personal mobility device that is collapsible to a compact size for storage, and optionally for use as a cane.

b. Background Art

Many individuals require mobility assistance, whether due to old age, disease, temporary injury, or other infirmity. Known mobility assistance devices include various types of canes, walkers, transport chairs, wheelchairs, rollators, and the like.

Extant mobility devices, however, exhibit numerous shortcomings. For example, current walkers and rollators are bulky and only foldable in one plane (e.g., they fold laterally, as do many wheelchairs, or forward, as do many rollators). This makes them difficult to transport.

Another disadvantage of extant mobility devices is their appearance. This can result in a situation where an individual who could benefit from using such device does not do so. Such individuals often cite the appearance of the device, and a concomitant fear of stigma and/or embarrassment, as the basis for their decision to forego using a mobility assistance device that might otherwise improve their quality of life.

Disadvantages are present even when an individual does elect to use a mobility assistance device. For example, extant mobile devices are heavy and complex. In many instances, the individual using the mobility assistance device lacks sufficient strength and/or dexterity to effectively manipulate (e.g., lift, fold, and/or unfold) the device.

BRIEF SUMMARY OF THE INVENTION

It would therefore be desirable to provide a personal mobility device that addresses the shortcomings and disadvantages of extant devices.

An object of the present invention is to provide a personal mobility device that is easily expanded and collapsed, even by those with limited strength and/or dexterity.

Another object of the present invention is to provide a personal mobility device that is easily transportable, even by those with limited strength and/or dexterity.

Still another object of the present invention is to provide a personal mobility device that is attractive, thereby addressing one of the reasons cited for non-use of extant mobility assistance devices.

A further object of the present invention is to provide a personal mobility device that collapses to a compact size.

A still further object of the present invention is to provide a personal mobility device that can optionally be utilized as a cane when collapsed.

Disclosed herein is a personal mobility device that includes a frame including a first frame member, a second frame member, a third frame member, and a fourth frame member. The first frame member is connected to the second frame member; the third frame member is connected to the fourth frame member; the first frame member is connected to the third frame member; and the second frame member is connected to the fourth frame member. The frame can be folded ("collapsed") and unfolded ("expanded") between an expanded configuration and a collapsed configuration in two substantially orthogonal planes. In preferred embodiments, the expansion or collapse occurs substantially simultaneously in both planes.

In one aspect, the first frame member is connected to the second frame member via a pivot joint. The pivot joint can include a pin. In another aspect, the fourth frame member passes through a slot in the third frame member. In still another aspect, the first frame member is connected to the third frame member via a first hinge; and the second frame member is connected to the fourth frame member via a second hinge.

Optionally, at least two of the first, second, third, and fourth frame members are telescoping members.

Typically, the personal mobility device will also include a seat suspended from the frame and a tension wire assembly that biases the frame into the collapsed configuration. A locking mechanism can be used to restrain the tension wire assembly from returning the frame to the collapsed configuration. The seat can be suspended from the frame and connected to the tension wire assembly in such a manner that loading the seat places the tension wire assembly in tension and forces the frame into the expanded configuration.

It is also contemplated that the personal mobility device can include a plurality of wheels, such as one wheel (or wheel assembly containing multiple wheels) is at the end of two or more of the frame members. Each wheel or wheel assembly can optionally include a variable resistance device that yields increasing friction with increasing wheel rotational speed.

An advantage of a personal mobility device as disclosed herein is that it is collapsible, rather than merely foldable.

A further advantage of a personal mobility device as disclosed herein is that it is easily expanded and collapsed, even by those with limited strength and/or dexterity. For example, in some embodiments, a personal mobility device as disclosed herein is biased to collapse.

Another advantage of a personal mobility device as disclosed herein is that it is easily transportable, even by those with limited strength and/or dexterity.

Still another advantage of a personal mobility device as disclosed herein is that it is attractive, thereby addressing one of the reasons cited for non-use of extant mobility assistance devices.

Yet another advantage of a personal mobility device as disclosed herein is that it collapses to a compact size.

A still further advantage of a personal mobility device as disclosed herein is that it can optionally be utilized as a cane when collapsed.

The foregoing and other aspects, features, details, utilities, and advantages of the present invention will be apparent from reading the following description and claims, and from reviewing the accompanying drawings.

DETAILED DESCRIPTION OF THE INVENTION

Figure 1:
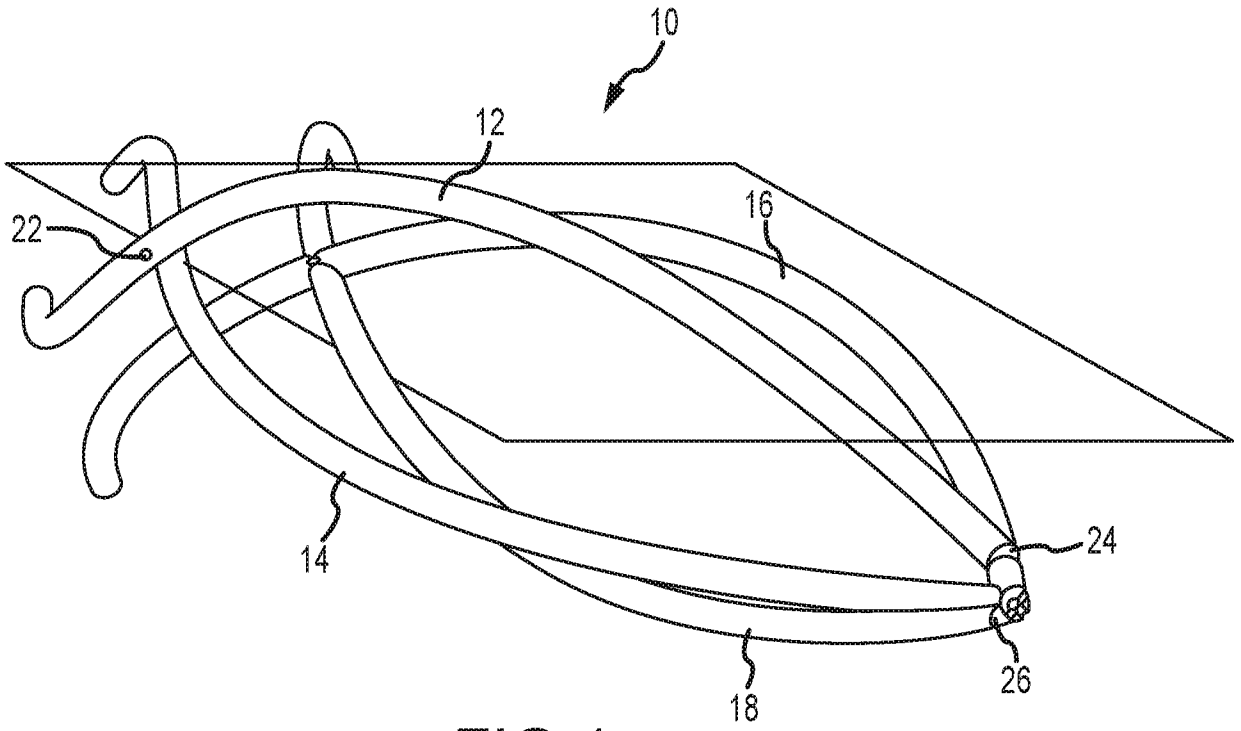
FIG. 1 illustrates, in perspective view, a personal mobility device according to one embodiment of the present invention in a collapsed configuration. For the sake of clarity, the seat, handles, and wheels are omitted from the illustration.
Figure 2:
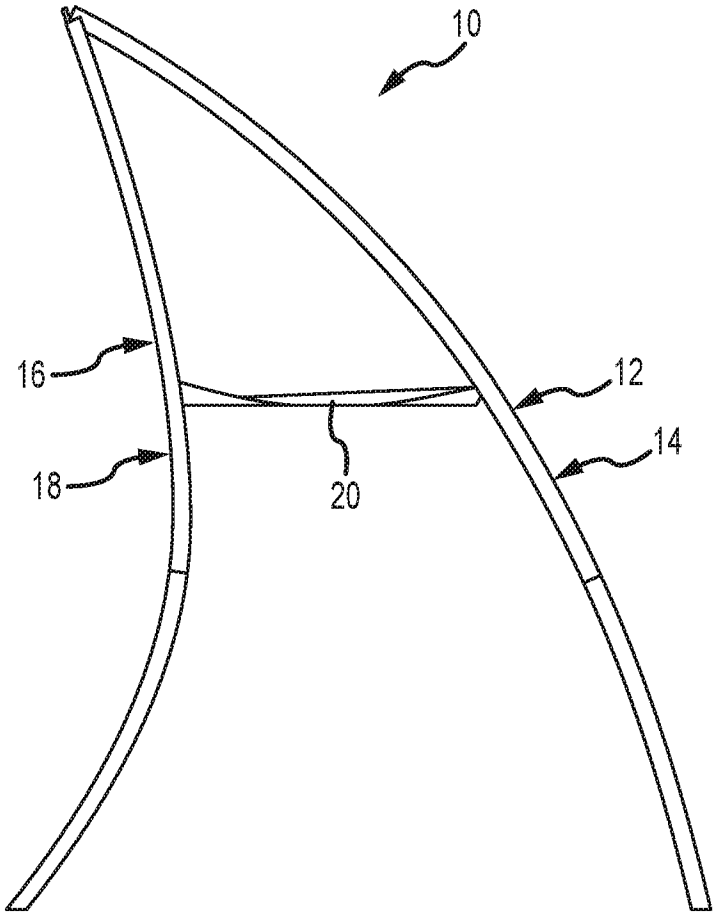
FIG. 2 is a side view of a personal mobility device according to one embodiment of the present invention in an expanded configuration. For the sake of clarity, the handles and wheels are omitted from the illustration.
Figure 3:
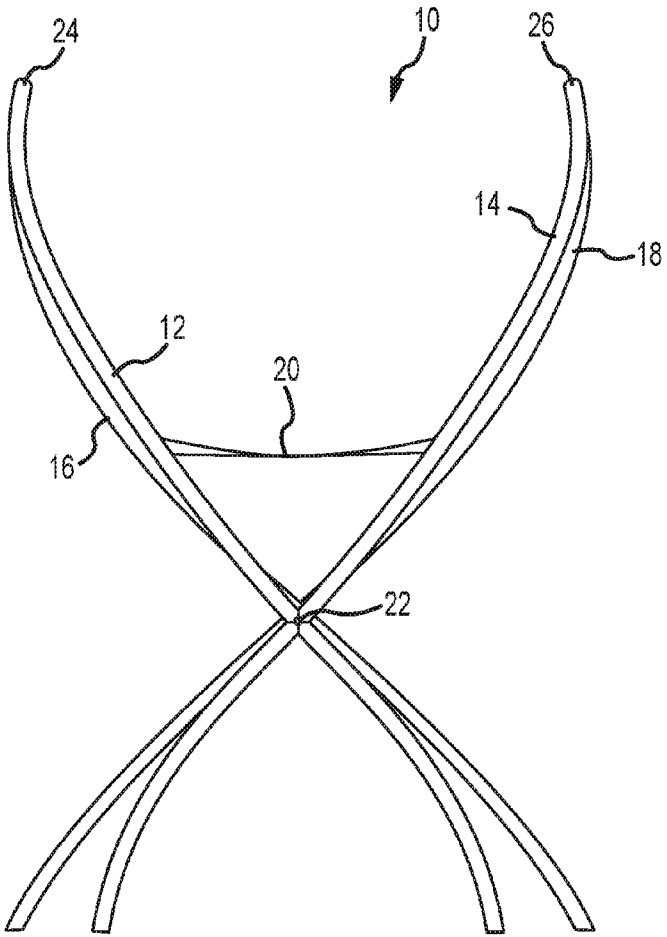
FIG. 3 is a front view of a personal mobility device according to one embodiment of the present invention in an expanded configuration. For the sake of clarity, the handles and wheels are omitted from the illustration.
Figure 4:
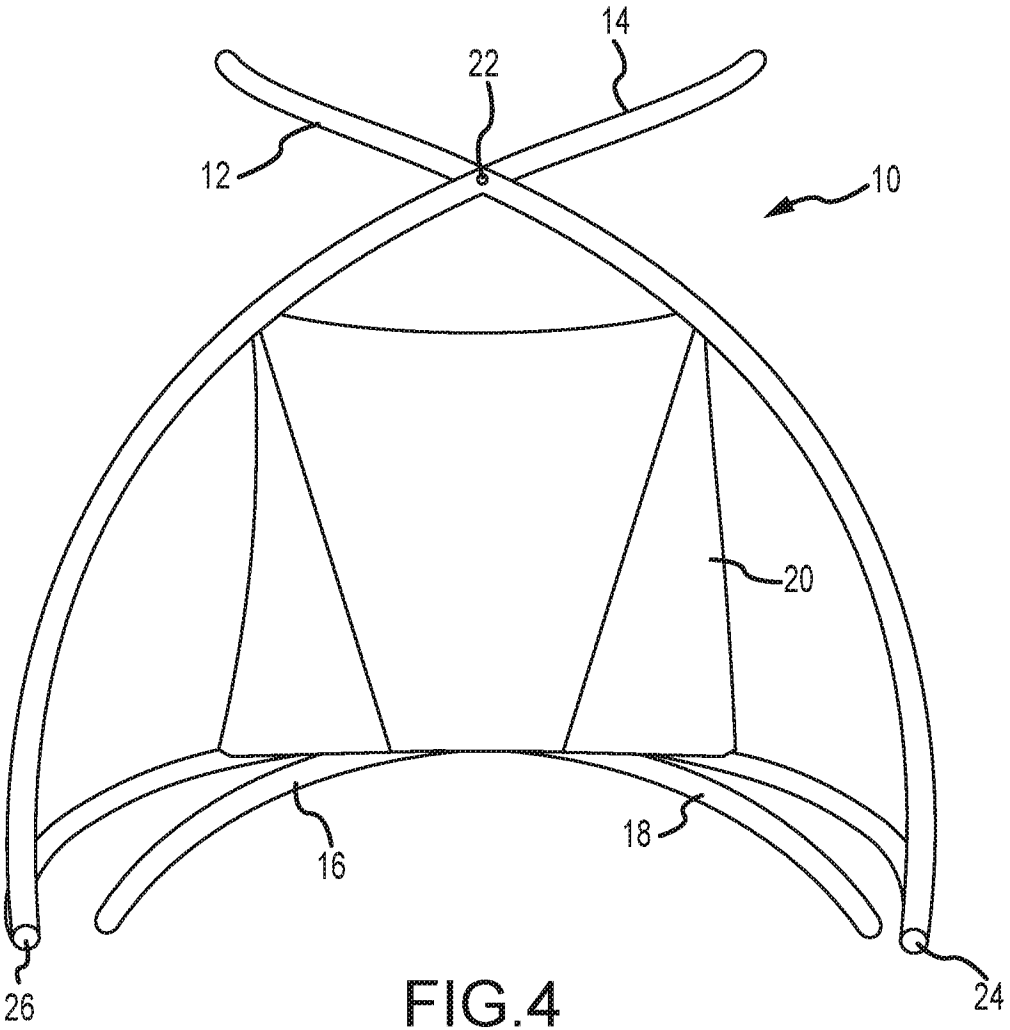
FIG. 4 is a top view of a personal mobility device according to one embodiment of the present invention in an expanded configuration. For the sake of clarity, the handles and wheels are omitted from the illustration.

FIGS. 1-4 depict several views of one embodiment of a personal mobility device 10 according to the present teachings. In general, personal mobility device 10 includes a frame made up of a first member 12, a second member 14, a third member 16, and a fourth member 18. FIGS. 2-4 also illustrate an optional seat 20 suspended from the frame.

Personal mobility device 10 has two configurations. In a first, collapsed configuration, shown in FIG. 1, personal mobility device can be conveniently stored or transported, such as in the trunk of an automobile or in the overhead compartment of an airplane. Alternatively, because personal mobility device 10 resembles a cane when collapsed, it can be used as such.

In a second, expanded configuration, shown in FIGS. 2-4, personal mobility device 10 is operable as a walker. If equipped with optional seat 20, personal mobility device 10 is also operable as a transport chair or rollator.

As illustrated to good advantage in FIG. 1, first frame member 12 is connected to second frame member 14. In certain aspects, the connection between first and second frame members 12, 14 is a pivot joint, such as a pin joint 22. Thus, first and second frame members 12, 14 are free to pivot relative to each other in the front plane (that is, the plane of the view of FIG. 3). Pin joint 22 is a particularly desirable option because of its enhanced load-bearing capacity. That is, as the ordinarily skilled artisan will appreciate, first and second frame members 12, 14, as the front "legs" of personal mobility device 10, will typically bear the bulk of a user's weight, such that the connection therebetween should be as robust as possible.

In similar fashion, FIG. 1 shows that third frame member 16 is connected to fourth frame member 18. Preferably, this is accomplished by routing fourth frame member 18 through a slot in third frame member 16. This allows third and fourth frame members 16, 18 to pivot relative to each other, also in the front plane. Advantageously, however, by routing fourth frame member 18 through third frame member 16, personal mobility device 10 in its collapsed configuration will be more compact when viewed in the side plane (that is, the plane of the view of FIG. 2). This enables easier storage of personal mobility device 10, for example in the trunk of an automobile. Of course, it is within the spirit and scope of the present invention to connect third and fourth frame members 16, 18 with any other suitable connection, including, without limitation, a pivot joint such as a pin joint 23 (see FIG. 19).

Thus, in general, expansion and collapse of personal mobility device 10 in the front plane (that is, width-wise) is provided by pivoting connections between first and second frame members 12, 14, on the one hand, and third and fourth frame members 16, 18, on the other hand.

FIG. 1 also depicts connections between first and third frame members 12, 16 and between second and fourth frame members 14, 18. In preferred embodiments of the invention, these connections are provided by folding hinges 24, 26, respectively. Hinges 24, 26 allow personal mobility device 10 to expand and collapse in the side plane—that is, they allow for depth-wise dimensional changes in personal mobility device 10.

Figure 18:
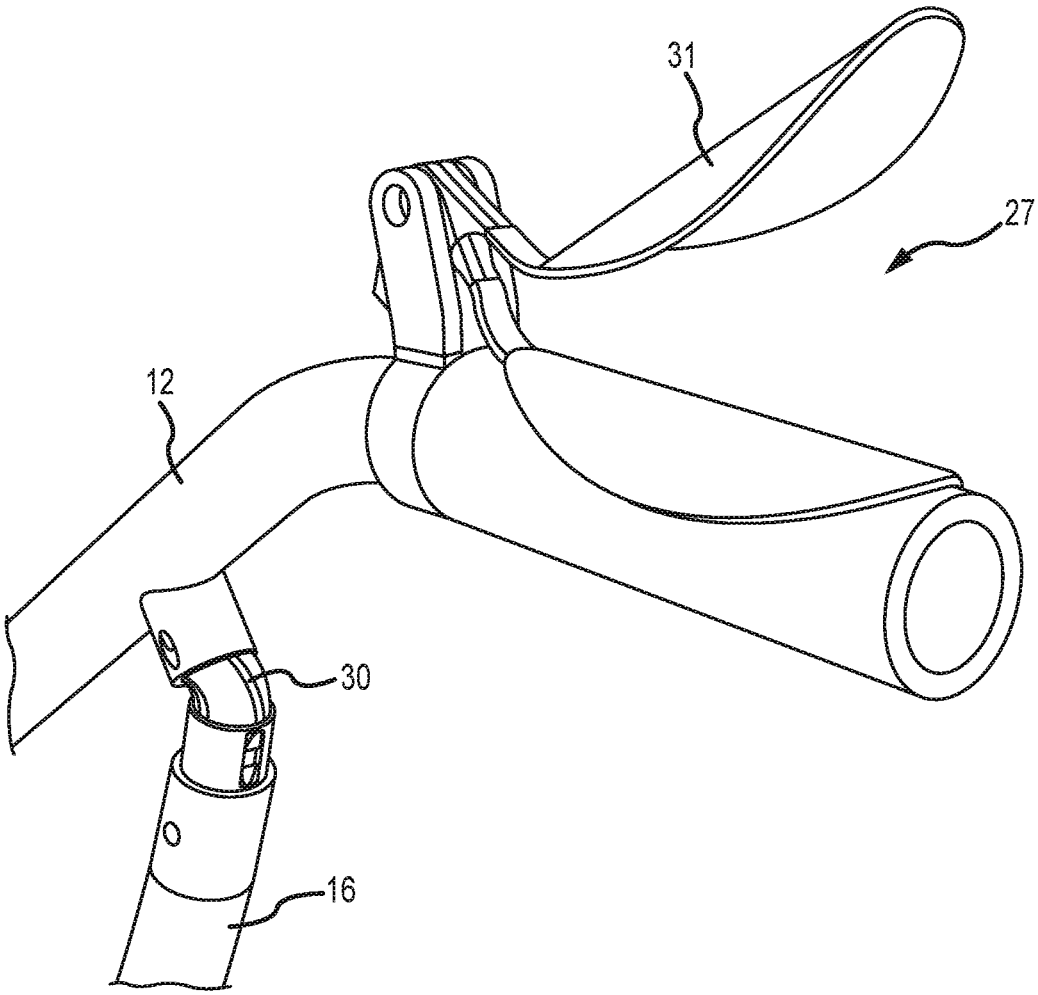
FIG. 18 is a close-up view of a handle for use in connection with the various embodiments disclosed herein.

The ordinarily skilled artisan will appreciate that handles 27 can be provided at the points of connection between first and third frame members 12, 16 and second and fourth frame members 14, 18. Such handles are sufficiently well understood that they need not be further described herein, except to note that it is contemplated that ergonomically-designed handles can be provided that are customized to a particular user. One suitable handle configuration is depicted in FIG. 18. The ordinarily skilled artisan will also appreciate that wheels 29 can be provided at the bottom ends of first, second, third, and fourth frame members 12, 14, 16, 18 (see, e.g., FIG. 19).

In addition to the more compact collapsed state of the personal mobility device disclosed herein relative to extant devices, another advantageous feature of personal mobility device 10 according to the teachings herein is that it is easily returned to its collapsed configuration, even if the user has limited dexterity and/or strength. This can be accomplished, for example, through the use of a tension wire assembly that biases the frame of personal mobility device 10 into its collapsed configuration, and that allows the frame of personal mobility device 10 to assume its expanded configuration under load (e.g., when the user leans or sits on personal mobility device 10).

Figure 5B:
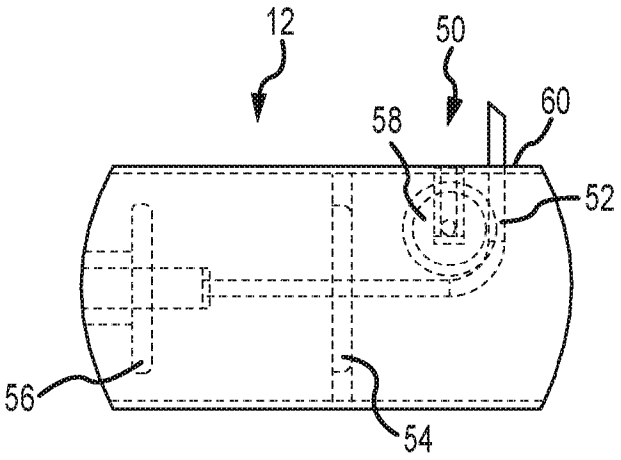
FIGS. 5A through 5C are views of a tension wire assembly for use in connection with the present teachings.
Figure 5A:
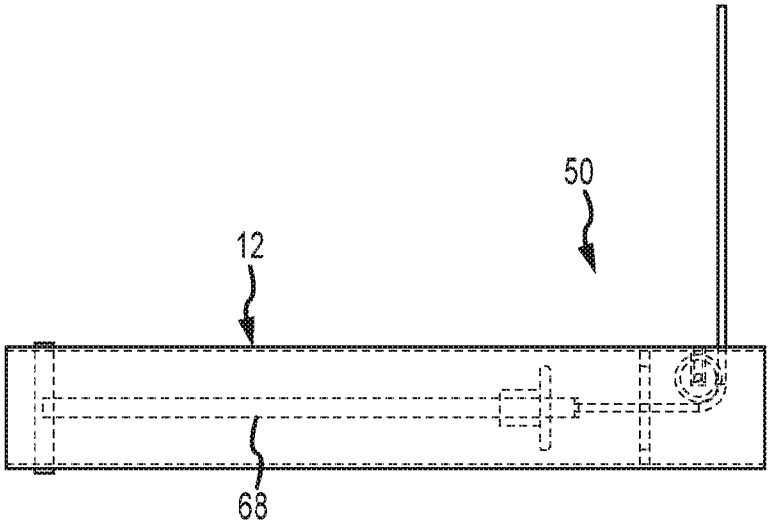
Figure 5C:
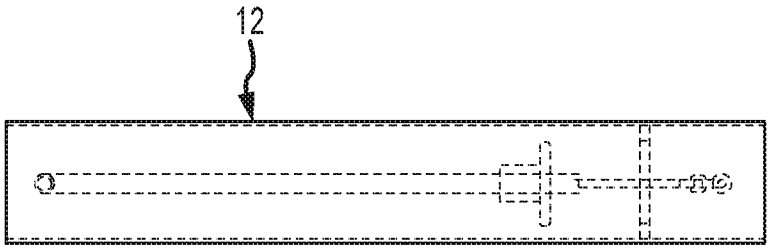

One suitable tension wire assembly 50 is shown in FIGS. 5A-5C, which are close-up and detail views of one of the frame members, e.g., first frame member 12. It should be understood, however, that tension wire assembly 50 can be in any number of frame members (e.g., anywhere from only one member to all four frame members).

As depicted to good advantage in the detail of FIG. 5B, tension wire assembly 50 generally includes a tension wire 52, an annular stopper 54 and mating plug 56, and a pulley 58 to minimize friction as tension wire 52 is paid out and taken up. Tension wire 52 emerges from first frame member 12 via an aperture 60.

Numerous constructions of tension wire 52 are possible. Suitable materials include wire rope, rope, cable, metal string, metal rope, and the like. Thus, the term "wire" should not be considered limiting. Preferably, however, tension wire 52 is formed from a plastic-coated metal, which provides increased safety and reduced friction.

Tension wire 52 is paid out of first frame member 12 and placed in tension when personal mobility device 10 is expanded. Loading personal mobility device (e.g., leaning on handles attached at hinges 24, 26 or sitting on optional seat 20, which can be connected to tension wire 52) will tend to expand personal mobility device 10 and pay out tension wire 52.

As tension wire 52 pays out, plug 56 moves towards, and ultimately engages, stopper 54. Once plug 56 and stopper 54 are engaged, personal mobility device 10 is locked in its expanded configuration.

Figure 6A:
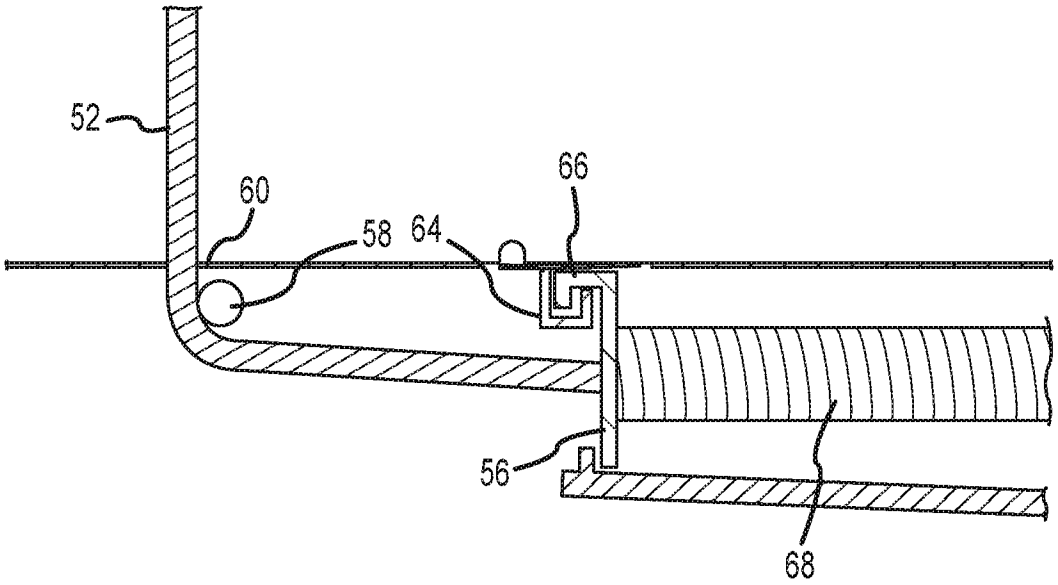
FIGS. 6A through 6C are schematic illustrations of one suitable locking assembly in accordance with the present teachings.
Figure 6B:
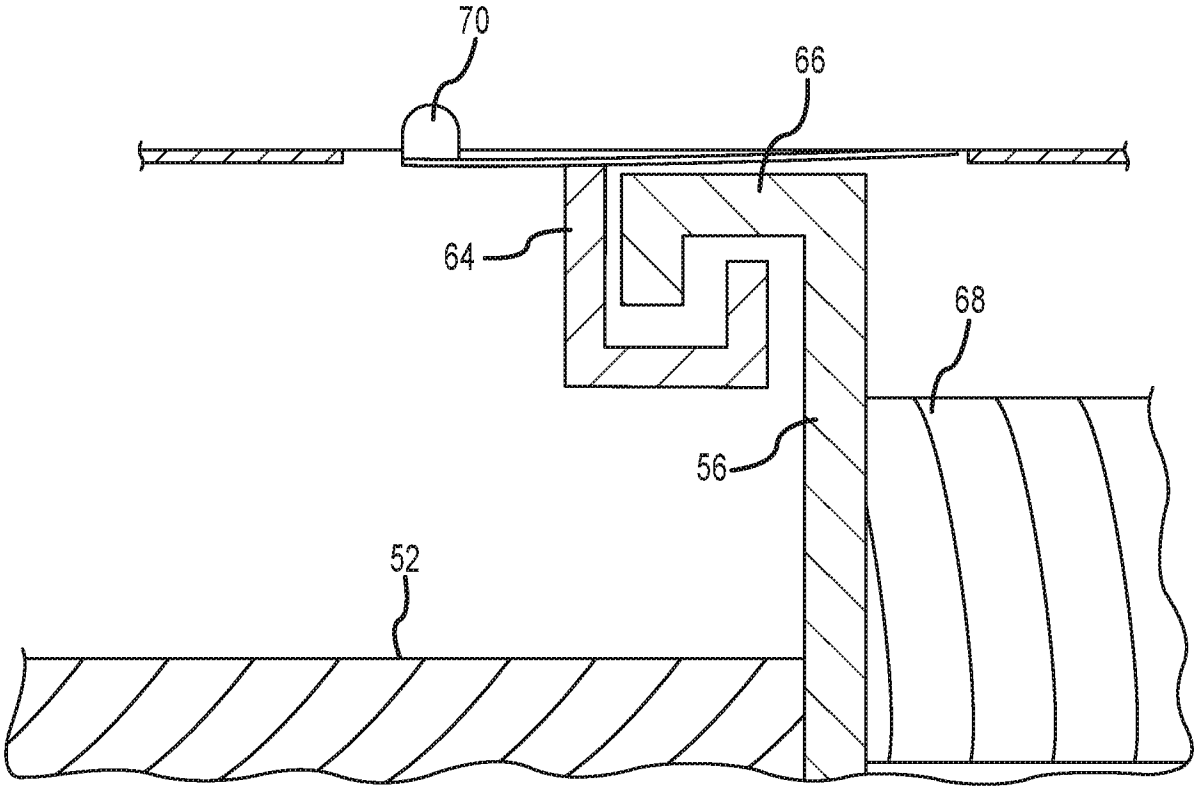
Figure 6C:
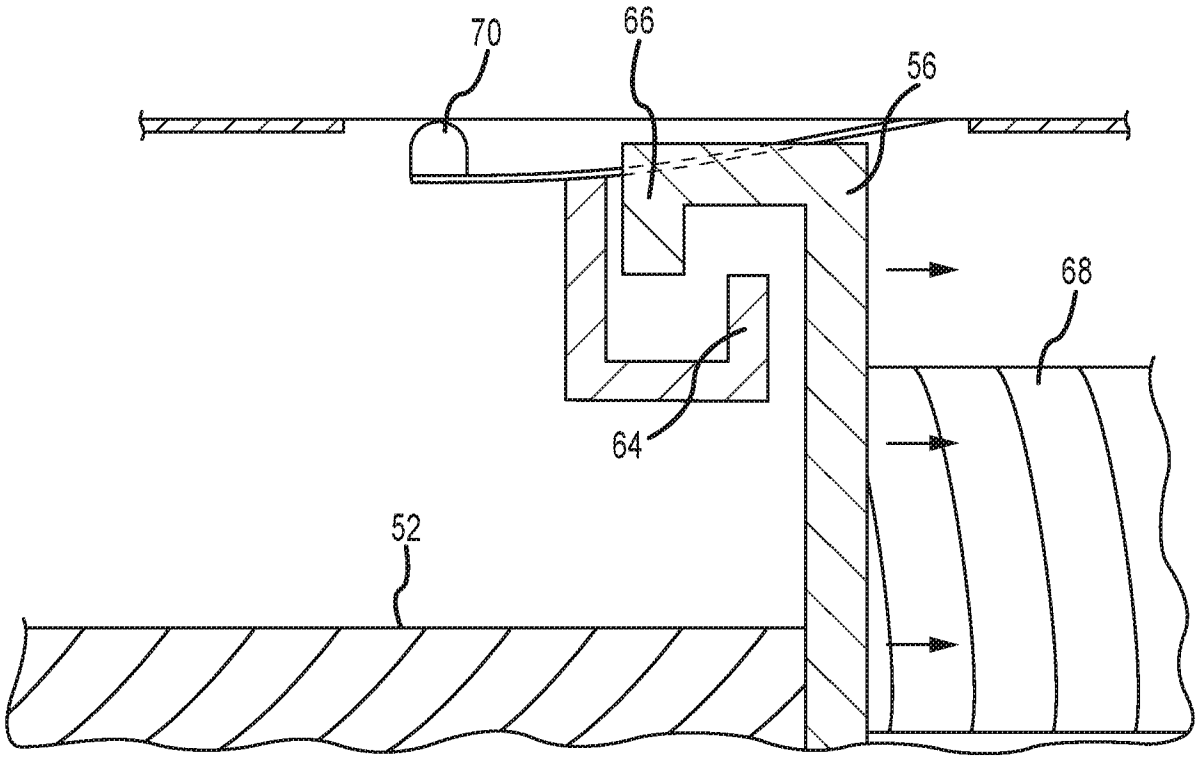
Figure 7:
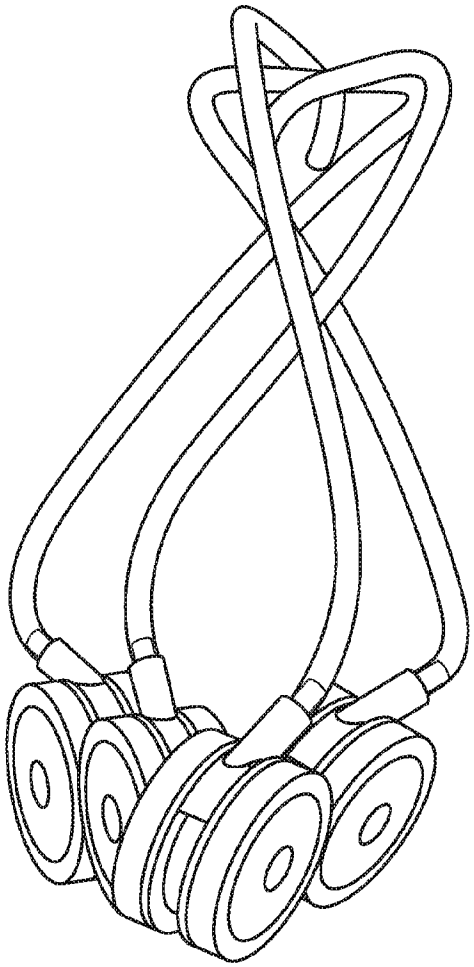
FIGS. 7 through 17 are additional views of personal mobility devices according to various embodiments of the present invention.
Figure 8:
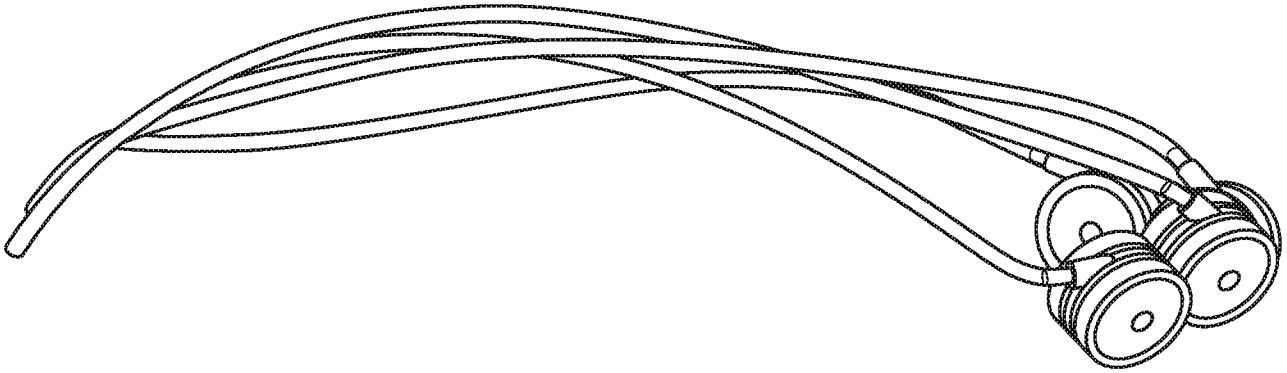
Figure 9:
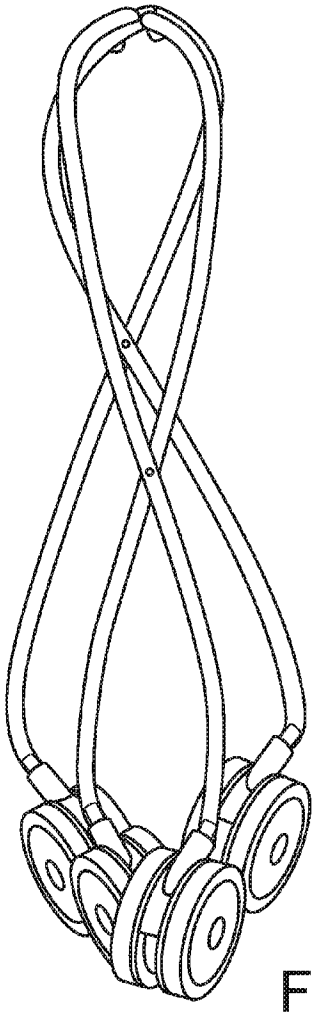
Figure 10:
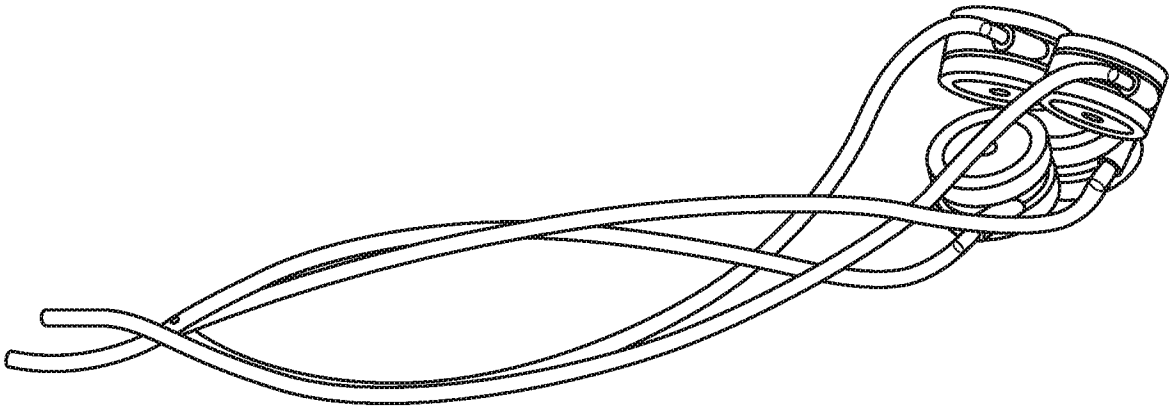
Figure 11:
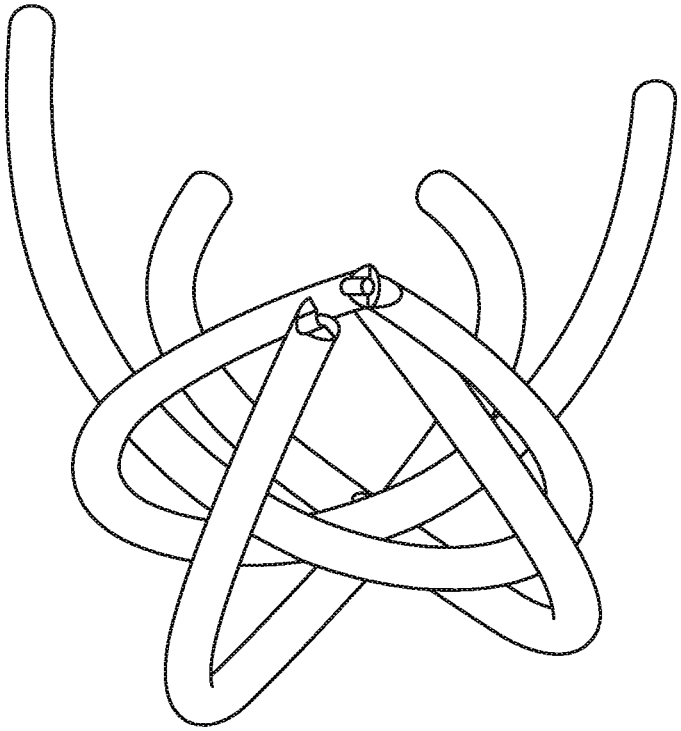
Figure 12:
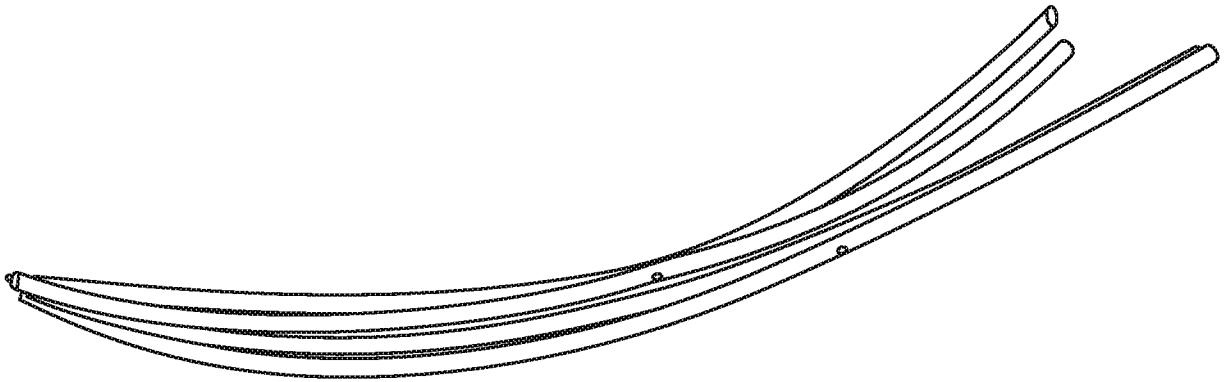
Figure 13:
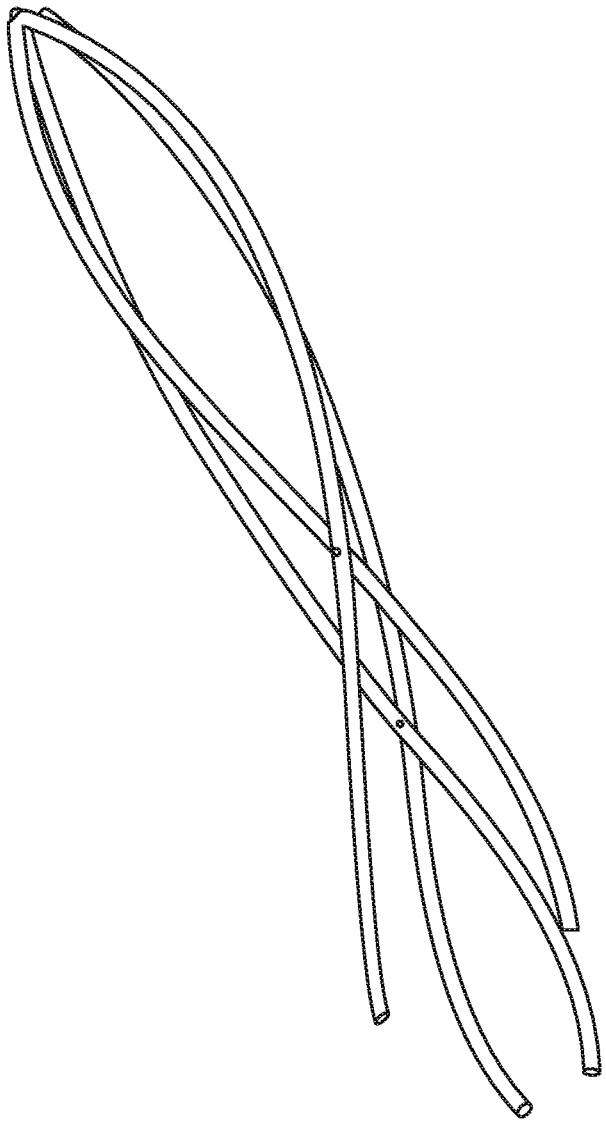
Figure 14:
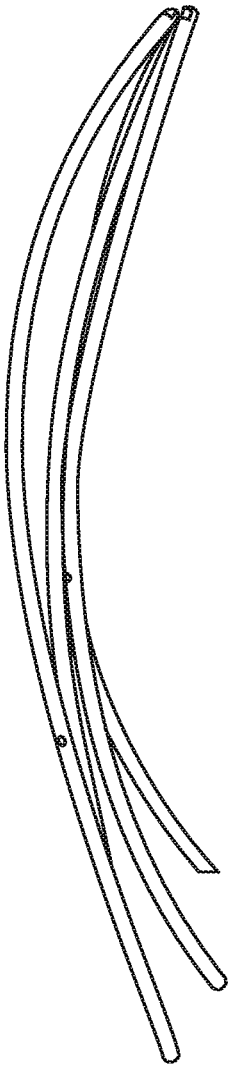
Figure 15:
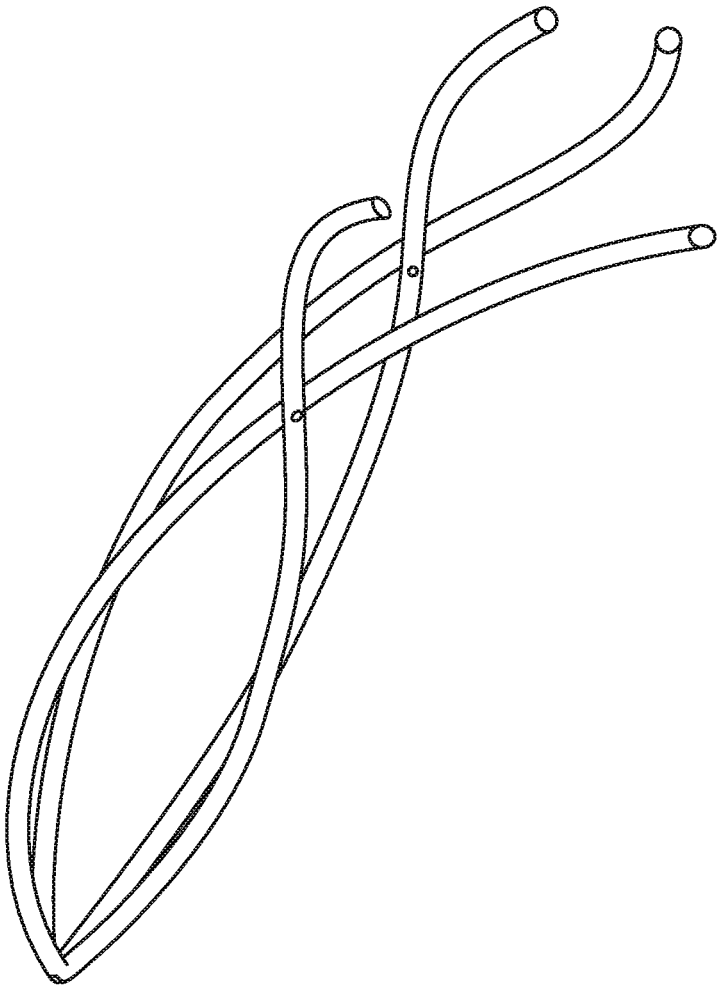
Figure 16:
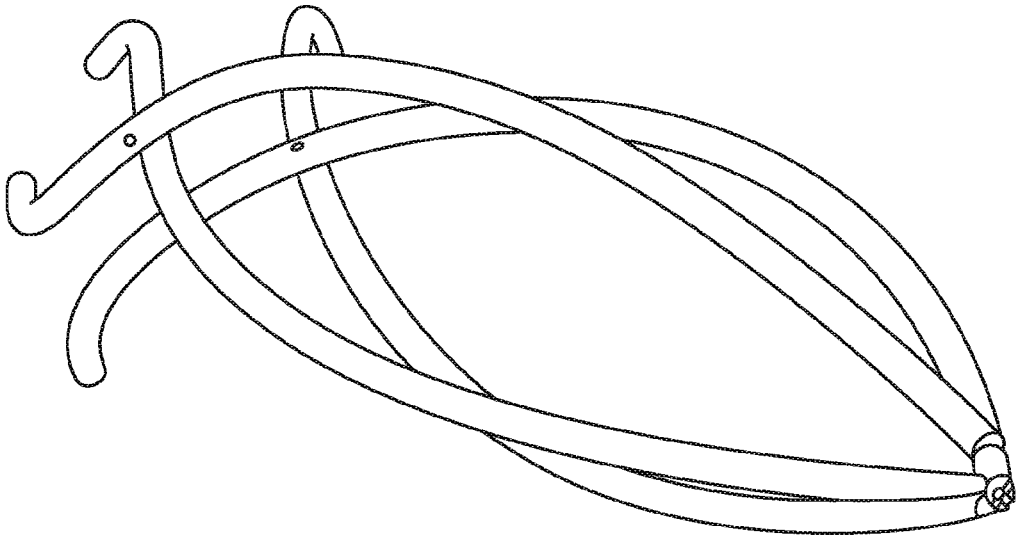
Figure 17:
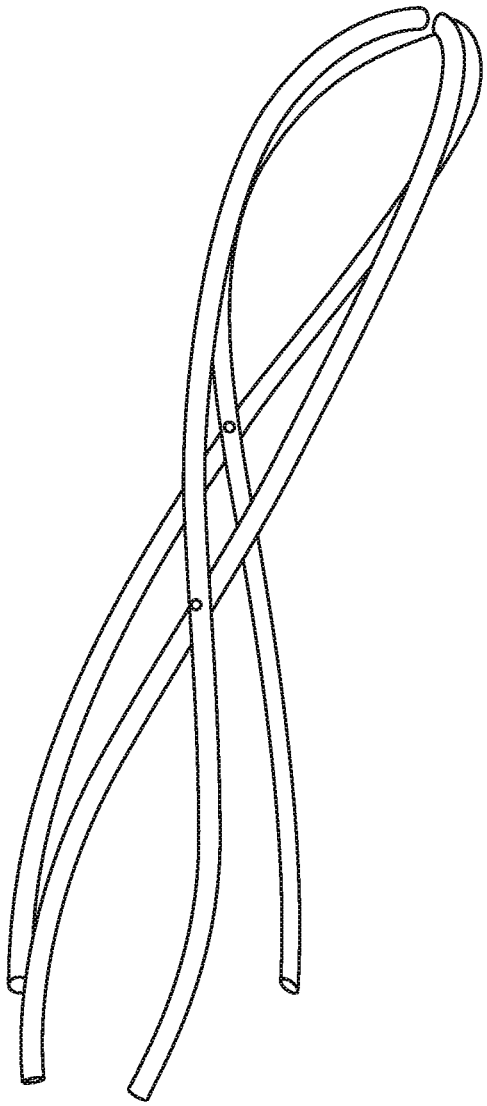

The ordinarily skilled artisan will appreciate how to construct a suitable locking mechanism to secure plug 56 to stopper 54. One suitable locking mechanism is depicted schematically in FIGS. 6A through 6C. As shown in FIG. 6A, and in detail in FIG. 6B, both plug 56 and stopper 54 include complementary lips 66, 64, respectively. When lips 64, 66 are engaged as shown in FIGS. 6A and 6B, elastic member 68, which is stretched when tension wire 52 is paid out, cannot return to its neutral state.

Depressing latch 70 disengages lips 64, 66, allowing plug 56 to release from stopper 54, freeing elastic member 68 to return to its neutral position. This, in turn, takes up tension wire 52 and substantially automatically collapses personal mobility device 10. Advantageously, only a minimal amount of force, easily generated even by those with limited manual strength and dexterity, is necessary to depress latch 70 and thus collapse personal mobility device 10. The reverse is also true—elastic member 68 has spring properties that are sufficient to take up tension wire 52, but is not so stiff that it takes substantial strength to pay out tension wire 52 when expanding personal mobility device 10.

The ordinarily skilled artisan will be able to select a suitable material for the construction of personal mobility device 10. In general, however, it is desirable for the material to be lightweight yet structurally strong, such as aircraft aluminum or carbon fiber.

Figure 19:
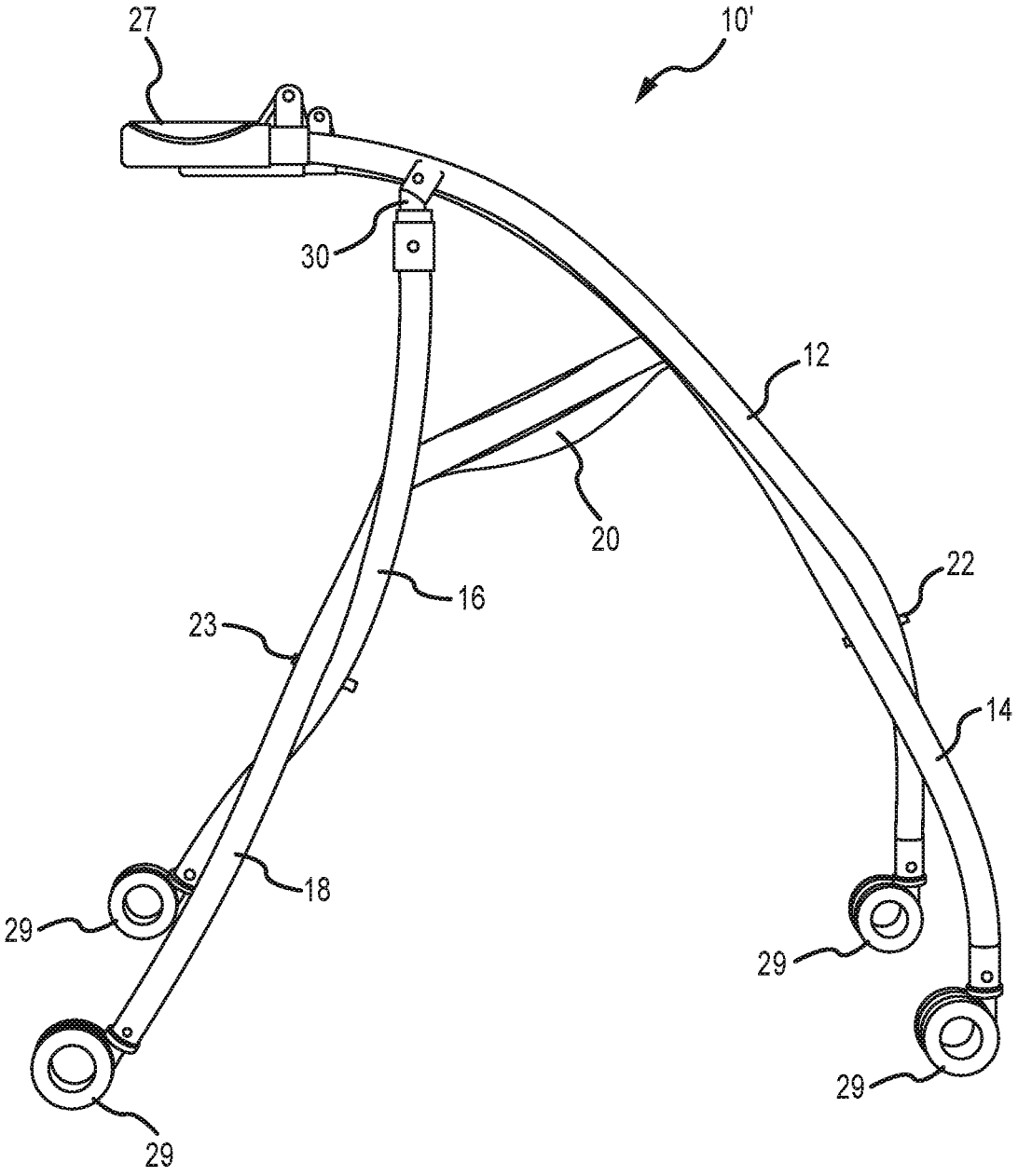
FIG. 19 is a side view of a personal mobility device according to another embodiment of the present invention.
Figure 20:
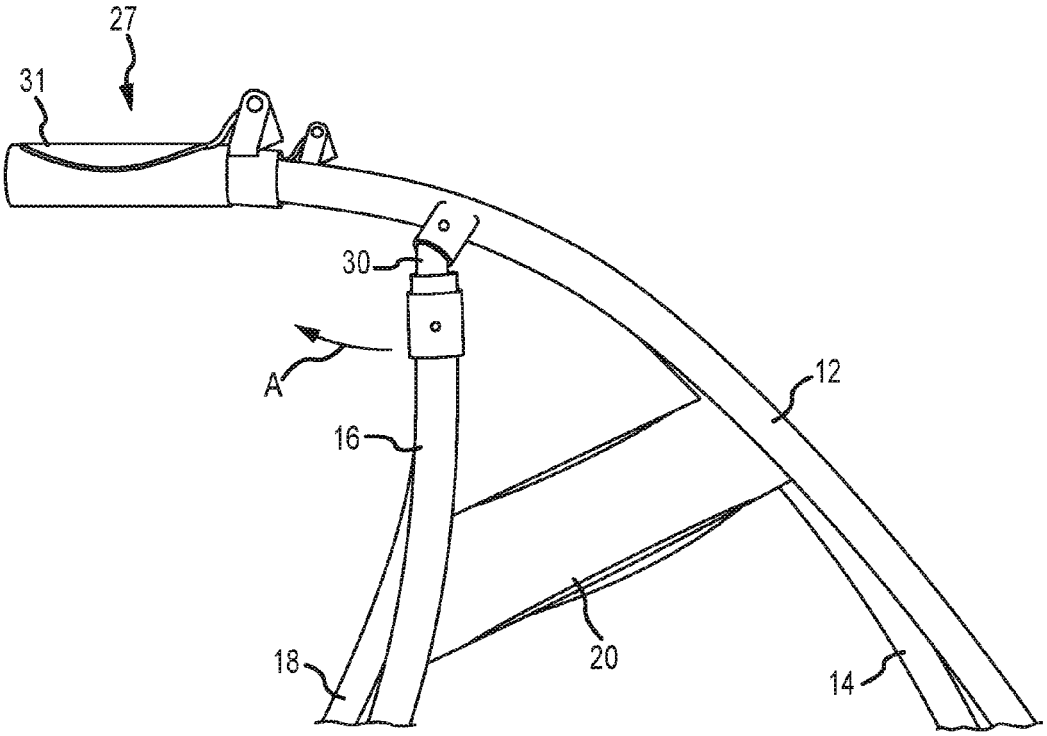
FIG. 20 is a close-up view a tendon joint.

Another embodiment of the present invention is depicted as personal mobility device 10' in FIGS. 19 and 20. In particular, in contrast to personal mobility device 10, which is discussed above as biased into its collapsed configuration, personal mobility device 10' is biased into its expanded configuration. This can be accomplished, for example, via the use of an elastic tendon 30 to connect first frame member 12 to third frame member 16 and second frame member 14 to fourth frame member 18.

Tendon 30 is oriented such that it is in its relaxed state when personal mobility device 10' is in its expanded configuration. That is, tendon 30 biases third and fourth frame members 16, 18 to move in the direction of arrow A in FIG. 20. Seat 20 holds tendon 30 in tension (e.g., it prevents personal mobility device 10' from opening further than desired).

Figure 21:
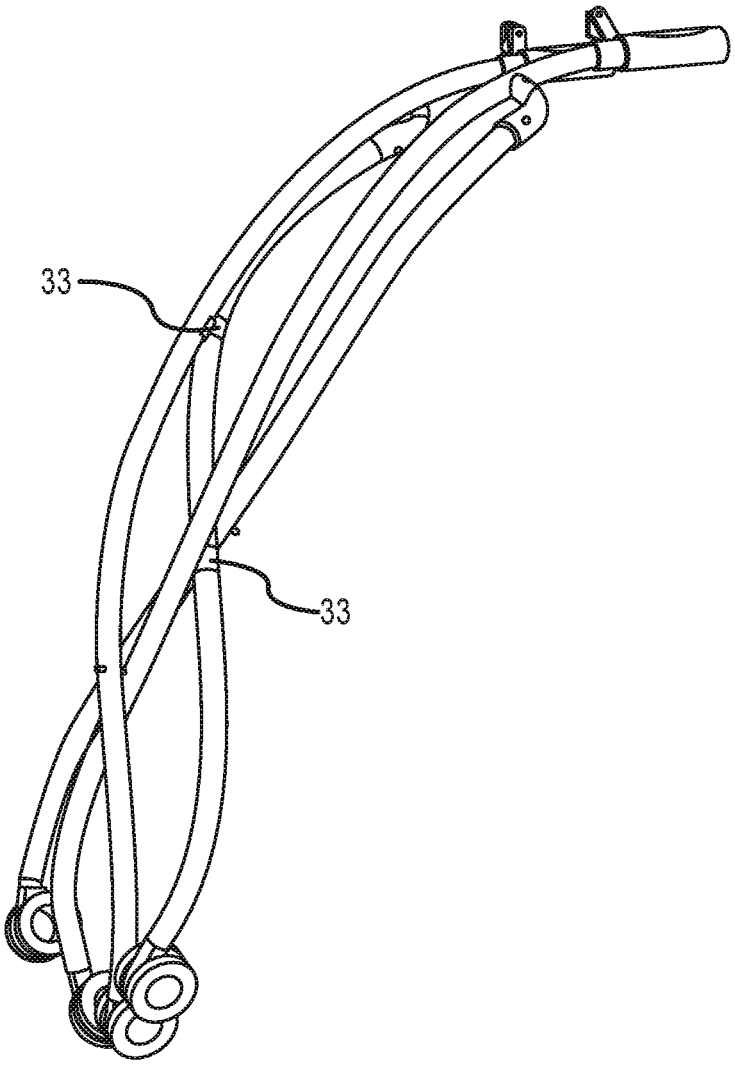
FIGS. 21 through 23 depict a magnetic closure for use in connection with the personal mobility device disclosed herein.
Figure 22:
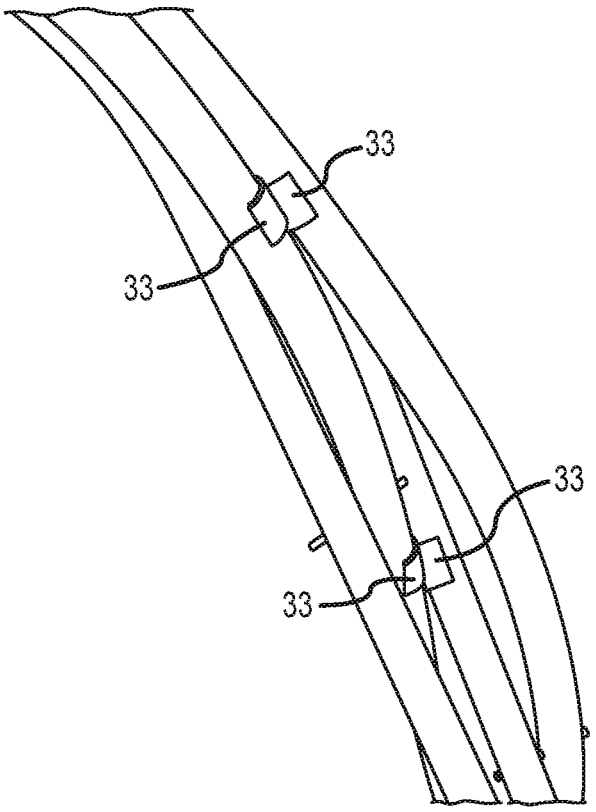
Figure 23:
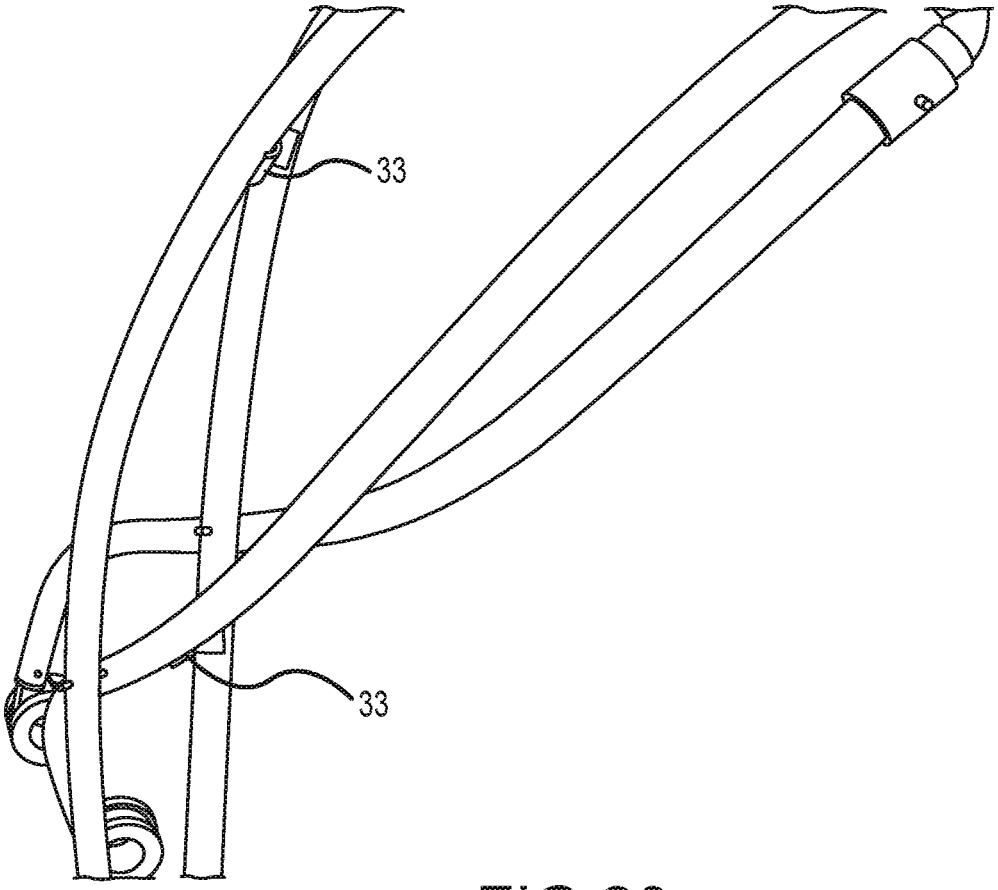

To collapse personal mobility device 10', the user folds handles 27 towards each other to collapse personal mobility device 10' in the front plane (e.g., width-wise). The user then folds personal mobility device 10' against the biasing force of tendon 30 (e.g., in the side-plane, or depth-wise). A magnetic closure, depicted in FIGS. 21-23 and including a plurality of complementary magnets 33 on frame members 12, 14, 16, and/or 18, will hold personal mobility device 10' closed. Only a minimal amount of force, easily generated even by those with limited manual strength and dexterity, is necessary to release the magnetic closure and thus expand personal mobility device 10' under the biasing force of tendon 30.

Although certain embodiments of this invention have been described above with a certain degree of particularity, those skilled in the art could make numerous alterations to the disclosed embodiments without departing from the spirit or scope of this invention.

For example, seat 20 can be made interchangeable, allowing the user of personal mobility device 10 to select a seat fabric that best suits his or her needs (e.g., a rugged, waterproof fabric for outdoor use of personal mobility device 10).

As another example, storage attachments, such as bags, pockets, sport bottle holders, cellular phone bags, shopping bag hooks, and the like can be connected to personal mobility device 10 (e.g., to the frame and/or to seat 20) via snaps, hooks, hook-and-loop fasteners, or the like.

As still another example, in some embodiments of the invention, two or more of frame members 12, 14, 16, 18 can include a telescoping assembly that allows personal mobility device 10 to change heights as desired by the user.

As yet another example, the wheels can be made retractable, foldable, or removable. The wheels can also be equipped with brakes or variable resistance devices that yield increasing friction with increasing rotational speed and/or gearing.

Figure 24:
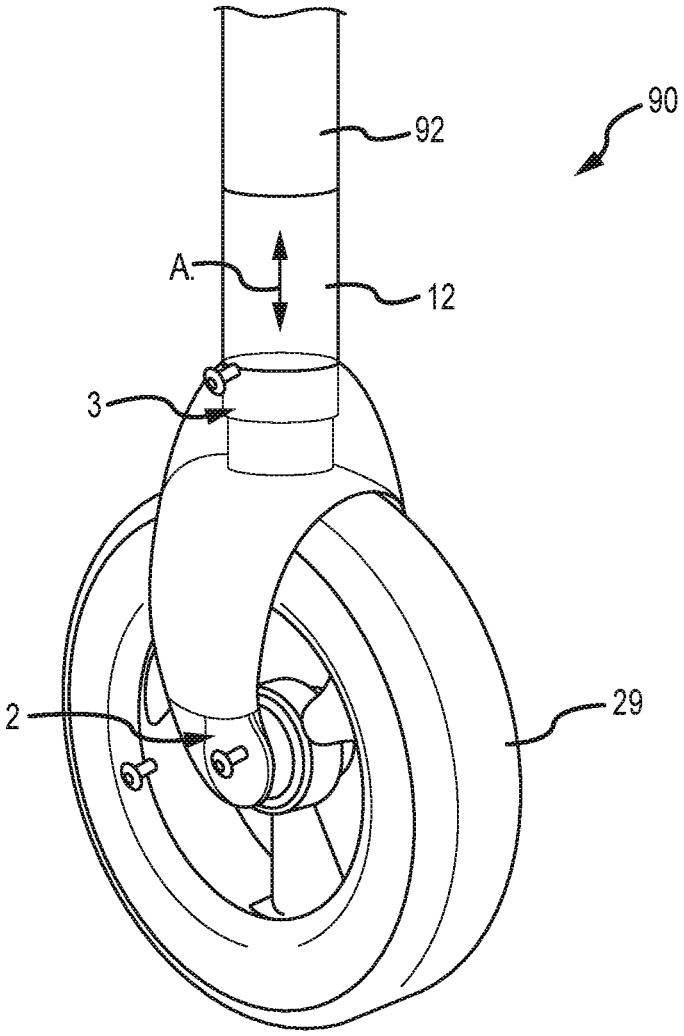
FIG. 24 illustrates a magnetic brake assembly.

FIG. 24 illustrates a magnetic brake assembly 90 including a magnet 92 located within a frame member (illustrated as frame member 12, though any one or several of frame members 12, 14, 16, and 18 could include a magnetic brake assembly 90). Magnet 92 is free to move up and down within frame member 12 (that is, along arrow "A" shown in FIG. 24). As the ordinarily-skilled artisan will appreciate, the faster wheel 29 moves, the greater the braking force exerted by magnet 92 will be. Thus, a magnetic brake assembly 90 has the advantage of minimizing the risk of forward falls—if a user were to begin to fall forwards, wheels 29 would speed up, and the resulting increase in braking force could prevent the fall from occurring.

For a more traditional friction-brake, handles 27 can include actuators 31 (see FIG. 18) to engage and disengage the brakes. Actuators 31 have two positions, open (illustrated in FIG. 18) and closed (illustrated in FIG. 19). It is contemplated that the open position of actuators 31 can correspond to the brakes being engaged, and the closed position of actuators 31 can correspond to the brakes being disengaged. Actuators 31 can further be biased into the open position, such that the user must push on actuators 31 in order to walk with the personal mobility device disclosed herein. In the closed position, actuators 31 can be designed to fit substantially flush against handle 27 (e.g., they can have complementary contours).

This configuration of actuators 31, which the ordinarily skilled artisan would perceive as the opposite of the conventional wisdom, enhances the safety of the personal mobility device disclosed herein. For example, it makes use of the user's natural inclination to lean on handles 27 to disengage the brakes and allow forward motion while preventing the device from rolling away from the user out of control. It also discourages the user from walking too far behind the device. The brake cables can also be routed through the interior of the frame members, further increasing safety.

All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A personal mobility device comprising:

a frame including a first frame member, a second frame member, a third frame member, and a fourth frame member, wherein the first frame member is directly connected to the second frame member;

the third frame member is directly connected to the fourth frame member;

the first frame member is directly connected to the third frame member; and the second frame member is directly connected to the fourth frame member, and wherein the frame can be folded and unfolded between an expanded configuration and a collapsed configuration in two substantially orthogonal planes at the direct connections between the first frame member and the second frame member, the third frame member and the fourth frame member, the first frame member and the third frame member, and the second frame member and the fourth frame member.

2. The personal mobility device according to claim 1, wherein the first frame member is directly connected to the second frame member via a pivot joint.

3. The personal mobility device according to claim 2, wherein the pivot joint comprises a pin.

4. The personal mobility device according to claim 1, wherein the fourth frame member passes through a slot in the third frame member.

5. The personal mobility device according to claim 1, wherein the third frame member is directly connected to the fourth frame member via a pivot joint.

6. The personal mobility device according to claim 5, wherein the pivot joint comprises a pin.

7. The personal mobility device according to claim 1, wherein the first frame member is directly connected to the third frame member via a first hinge; and the second frame member is directly connected to the fourth frame member via a second hinge.

8. The personal mobility device according to claim 1, wherein the first frame member is directly connected to the third frame member via a first tendon; and the second frame member is directly connected to the fourth frame member via a second tendon, and wherein the first tendon and the second tendon bias the personal mobility device into the expanded configuration.

9. The personal mobility device according to claim 8, further comprising a seat suspended from the frame, and wherein the seat limits a degree to which the first tendon and second tendon are able to expand the personal mobility device.

10. The personal mobility device according to claim 1, wherein at least two of the first, second, third, and fourth frame members are telescoping members.

11. The personal mobility device according to claim 1, further comprising a seat suspended from the frame.

12. The personal mobility device according to claim 1, further comprising a tension wire assembly that biases the frame into the collapsed configuration.

13. The personal mobility device according to claim 12, further comprising a locking mechanism to restrain the tension wire assembly from returning the frame to the collapsed configuration.

14. The personal mobility device according to claim 12, further comprising a seat suspended from the frame and connected to the tension wire assembly such that loading the seat places the tension wire assembly in tension and forces the frame into the expanded configuration.

15. The personal mobility device according to claim 1, further comprising a plurality of wheels, wherein each of the first, second, third, and fourth frame members terminates in a wheel.

16. The personal mobility device according to claim 15, wherein each wheel includes a variable resistance device that yields increasing friction with increasing wheel rotational speed.

17. The personal mobility device according to claim 15, further comprising a brake assembly operable to brake at least one of the plurality of wheels.

18. The personal mobility device according to claim 17, wherein the brake assembly comprises a magnetic brake assembly.

19. The personal mobility device according to claim 17, wherein the brake assembly includes a handle having an actuator that is operable to engage and disengage the brake assembly.

* * * * *